US006860123B1

(12) United States Patent
Uhlin

(10) Patent No.: US 6,860,123 B1
(45) Date of Patent: Mar. 1, 2005

(54) APPARATUS FOR CLEANING TEXTILES WITH A DENSIFIED LIQUID TREATMENT GAS

(75) Inventor: Göran Uhlin, Lagan (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/936,828

(22) PCT Filed: Mar. 17, 2000

(86) PCT No.: PCT/SE00/00527

§ 371 (c)(1),
(2), (4) Date: Sep. 18, 2001

(87) PCT Pub. No.: WO00/56970

PCT Pub. Date: Sep. 28, 2000

(30) Foreign Application Priority Data

Mar. 19, 1999 (SE) ..... 9901002

(51) Int. Cl.[7] ..... D06F 48/08
(52) U.S. Cl. ..... 68/5 C; 68/18 C; 68/207
(58) Field of Search ..... 68/5 R, 5 C, 12.08, 68/12.09, 12.13, 18 C, 207; 8/142, 158

(56) References Cited

U.S. PATENT DOCUMENTS 5,412,958 A * 5/1995 Iliff et al. ..... 68/5 C
5,827,329 A * 10/1998 Champeau ..... 8/142
5,881,577 A * 3/1999 Sauer et al. ..... 239/136
5,904,737 A * 5/1999 Preston et al. ..... 8/158
5,937,675 A * 8/1999 Stucker ..... 68/18 R
5,946,945 A * 9/1999 Kegler et al. ..... 68/18 R

* cited by examiner

*Primary Examiner*—Frankie L. Stinson
*Assistant Examiner*—Joseph L Perrin
(74) *Attorney, Agent, or Firm*—Pearne & Gordon LLP

(57) ABSTRACT

A device for cleaning textile articles with a densified liquid state treatment gas, comprising a treatment chamber (10), a supply tank (18) for densified treatment gas and an evaporator chamber (36), which spaces are connected to each other by way of suitable tubes to allow pressure balance between the different spaces, filling of the treatment chamber (10) with liquid state treatment gas from the supply tank (18), as well as drainage of liquid state treatment gas from the treatment chamber (10) to the evaporator chamber (36). Compressor means (46) are arranged which are organized partly to achieve essentially complete drainage of gaseous treatment gas from the treatment chamber (10), and partly constitute the driving means during one in the treatment process included distillation phase, where densified treatment gas in the evaporator chamber (36) is gasified and through condenser means (44) conveyed back to the supply tank (18). The condenser means are in heat conducting touch with the evaporator chamber (36), and form together with the compressor means (46) a heat pump, which alone furnish the necessary heat energy for evaporating the liquid in the evaporator chamber (36). In a modified embodiment the treatment chamber (10) is adapted so as to act also as an evaporation chamber.

3 Claims, 2 Drawing Sheets

APPARATUS FOR CLEANING TEXTILES WITH A DENSIFIED LIQUID TREATMENT GAS

Figure 1:
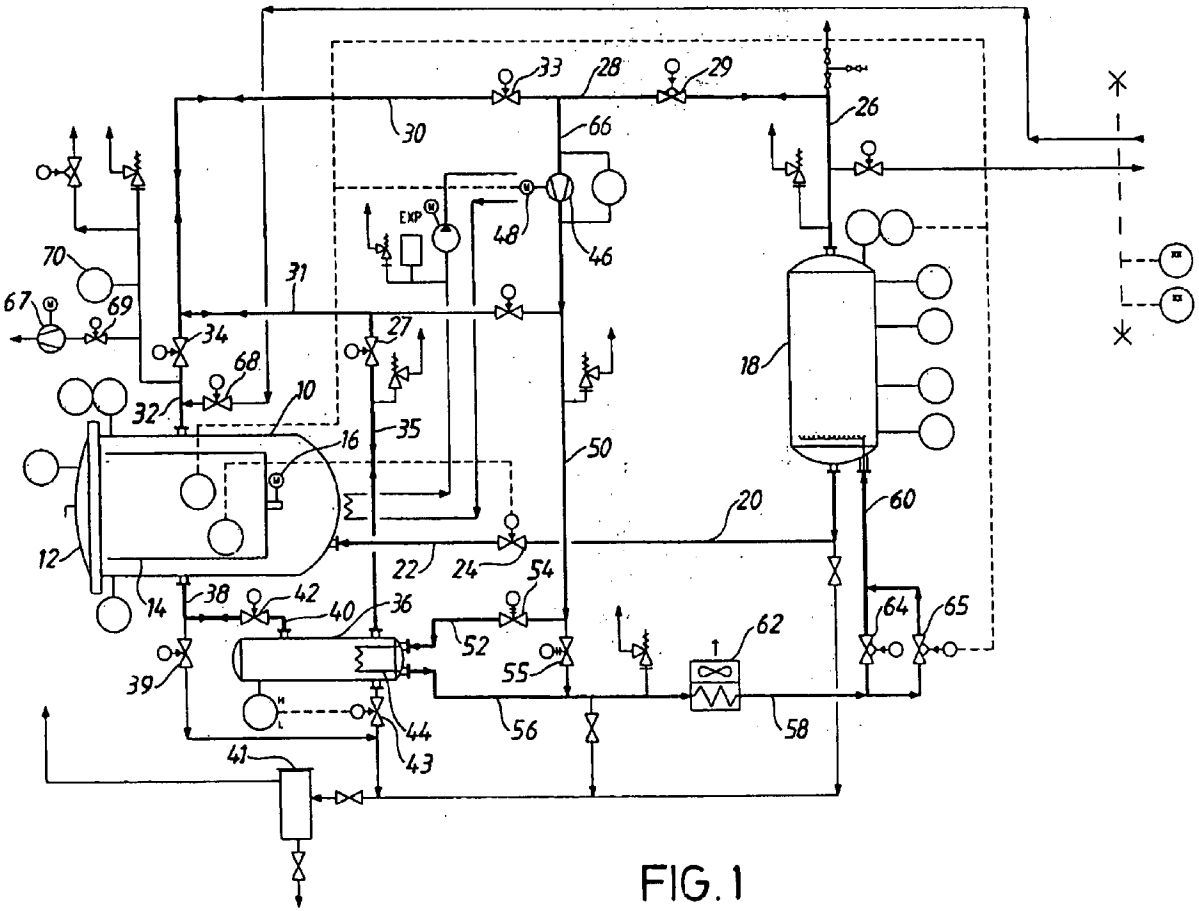

This application claims the benefit of International application Number PCT/SE00-00527, which was published in English on Sep. 28, 2000.

FIELD OF THE INVENTION

The present invention relates to an apparatus for cleaning textile objects using a densified, liquid treatment gas, which preferably, is constituted by carbon dioxide.

BACKGROUND OF THE INVENTION

By washing textile objects, one has traditionally had the possibility to choose to treat these in a detergent solution based on water, or to utilize a dry cleaning method, where water is replaced by trichlorethene or perchlorethene. By what is known as common wash, which can be used for most articles of clothing, garments are placed in a treatment drum of a washing machine to be cleaned in a detergent solution based on water. For garments not washed in water, the garments are instead placed in a dry-cleaning machine and are cleaned in a wash-solution based on solvents, usually containing perchlorethene. Those solutions based on solvents have, from an environmental standpoint, been found to be inappropriate, and hence one has tried to find replacement liquids, which from a washing viewpoint are equally good as wash-solutions based on solvents earlier used, but which at the same time do not demonstrate the drawbacks from an environmental viewpoint, which are inherent in the wash-solutions based on solvents.

Such a replacement liquid having suitable properties for cleaning of textiles is carbon dioxide in liquid or supercritical state. The patent specification U.S. Pat. No. 5,267,455 describes a system for chemically cleaning textiles using carbon dioxide in liquid or supercritical state. This system include a treatment chamber, a supply tank for liquid carbon dioxide and likewise a vaporization chamber for liquid carbon dioxide, which has been used in the process and shall after purification be brought back to the supply tank. The liquid carbon dioxide is pumped from the supply tank to the treatment chamber, and when the cleaning process has been completed, from the treatment chamber to the vaporization chamber. The vaporization of the liquid carbon dioxide takes place by heating, and the evaporated gas is conveyed through filters and a condensing apparatus back to the supply tank. The described process depicts how the chemical cleaning using liquid carbon dioxide should possibly come about, but is by no way optimized with respect to recovering from treatment and vaporization chambers liquid and gaseous carbon dioxide respectively. Because of the existing pressure conditions in the supply tank ands in the vaporization chamber one cannot completely empty the vaporization chamber of gas, without specific measures. The solution will be to evacuate surplus gas to the ambient air, which entails that this gas must be replaced from a gas supplier, and that to a cost which is not negligible.

WO 99/13 148 describes a device for cleaning garments in liquid carbon dioxide. Like the apparatus of U.S. Pat. No. 5,267,455, WO 99/13 148 describes a device comprising a treatment chamber, a supply tank and a vaporization chamber, which are mutually connected to each other by way of suitable tubes and valve means. Further, the device comprises compressor means, which is used partly, most important, to completely empty the treatment chamber of carbon dioxide, partly to serve as driving means for carbon dioxide gas, which during one in treatment process included vaporization process from the vaporizer via condenser means shall be brought back to the supply tank. To evaporate liquid carbon dioxide in the vaporizer there are arranged particular heating means, and further, the condensing of carbon dioxide gas, which via the compressor means is directed to the condensation means, takes place without taking care of the energy thereby released.

Thus one object of the present invention is to improve the device for cleaning textiles mentioned as known, as far as possible all in the system circulating carbon dioxide being taken care of, and after cleansing being brought back to the supply tank. Another object is to take care of the energy released during the process, and utilize this in process steps, where otherwise energy provided from outside has to be utilized.

SUMMARY OF THE INVENTION

The stated objects will be obtained by a device for cleaning textiles with densified, liquid state treatment gas.

DETAILED DESCRIPTION OF THE INVENTION

Figure 2:
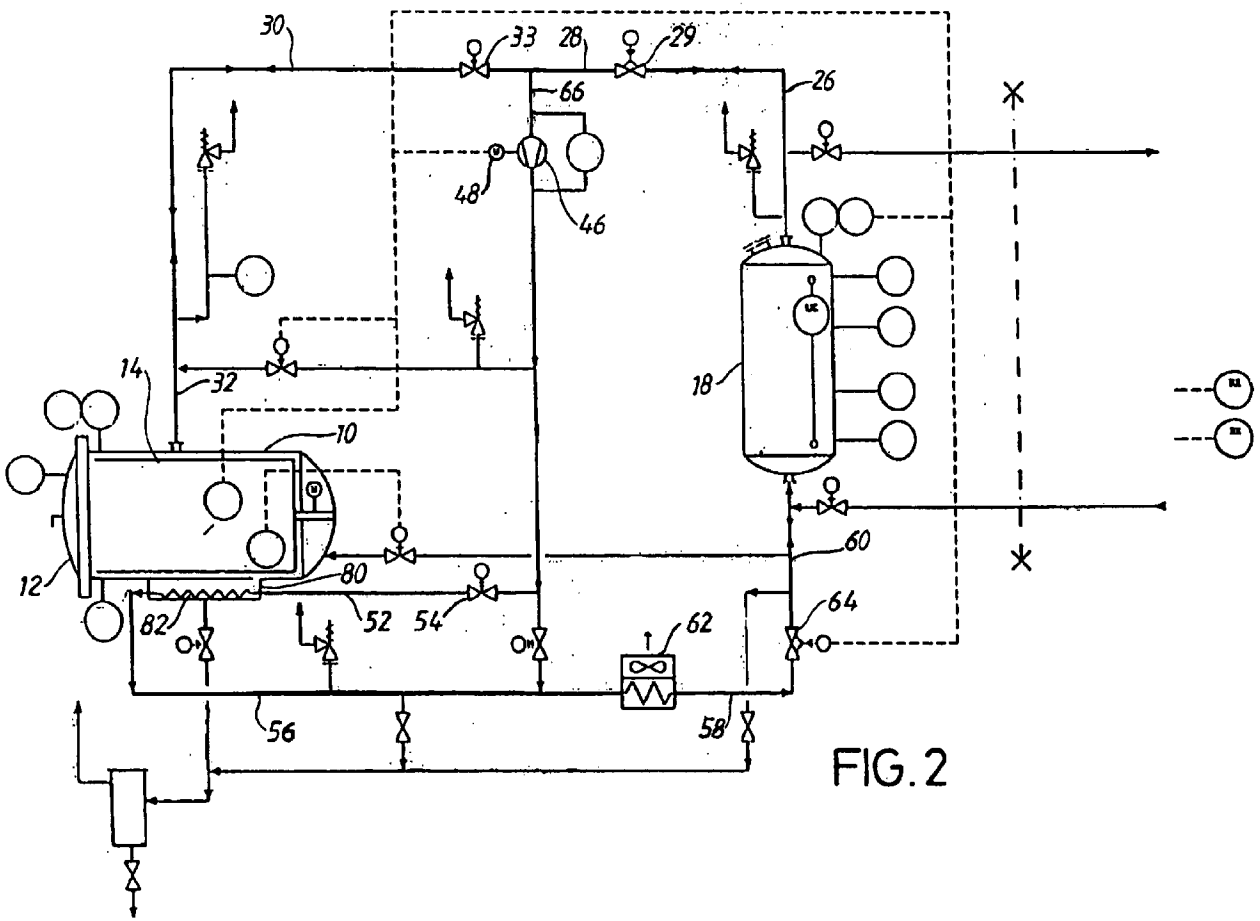

The invention will herein be described in detail with reference to embodiments shown on the drawing, in which FIG. 1, schematically, shows a first embodiment of a device, according to the invention, intended for cleaning textiles in a washing fluid consisting of liquid carbon dioxide. FIG. 2 shows a modified embodiment of the device according to FIG. 1.

With reference to FIG. 1, the device comprises, expressed in common language, a washing machine, a treatment chamber 10, in which the textiles to be cleaned are introduced. The treatment chamber 10 is of heavy duty accomplishment to be able to resist the high pressures, which are required to keep the carbon dioxide in fluid state at a temperature in the main corresponding to room temperature. A door 12 is arranged to seal the chamber 10, and also this is in the same solid accomplishment. Suitable locking means, not shown, are arranged in order to keep the door 12 in a locked position during the cleaning operation in the treatment chamber 10.

To get the cleaning of the textiles in the treatment chamber as effective as possible, an agitation of those is desired, and for that object the textiles are supported in an interior of a revolving washing drum 14 inside the treatment chamber 10. In prevalent way the drum may be equipped with carry-over bulges, not shown, intended to lift the textiles from the bottom of the drum during its revolving, and again release these as they have reached the upper part of the drum. In this way different parts of the textiles are brought in contact with the liquid carbon dioxide in a more uniform way. The revolving driving of the drum can be brought about with the aid of an electric motor 16, by way of a suitable transmission, for example in the way described in the U.S. Pat. No. 5,267,455.

For supply of the liquid carbon dioxide, there is arranged a supply tank 18, the lower part of which is through tubes 20, 22 and valve 24 connected with the lower part of the treatment chamber 10. The upper part of the supply tank 18 is through tubes 26, 28, 30 and 32 along with valves 29, 33, 34 connected with the upper part of the treatment chamber 10.

For recycling of the carbon dioxide used in the cleaning process, there is arranged an evaporator chamber 36, which through tubes 38, 40 with intermediate valve 42 is connected to the treatment chamber 10 at its lowermost part. For vaporization of the liquid carbon dioxide, which is conveyed from the treatment chamber 10 through the tubes 38, 40 and the valve 42 to the evaporator chamber 36, a heat exchanger in form of a condenser 44 is used.

A compressor 46 is a vital component in the washing machine according to the invention, and this compressor is driven by an electric motor 48. The compressor is used in substance to completely empty the treatment chamber 10 and the evaporator chamber 36 after the cleaning and vaporization processes are finished, respectively. The pressure side of the compressor 46 is connected to an inlet to the heat exchanger 44 through tubes 50, 52 and an intermediate valve 54, and the outlet of the lower most part of the exchanger 44 is connected to the supply tank 18 through tubes 56, 58 and 60, an additional heat exchanger 62 and a valve 64. The low side of the compressor is connected to the tube 28 through a tube 66.

A valve 69 is arranged to evacuate air from the treatment chamber 10 before this will be filled with carbon dioxide. To compensate carbon dioxide lost during a preceding treatment phase, a further valve 68 is arranged to permit filling of the treatment chamber with new carbon dioxide, before a new treatment phase is begun. Carbon dioxide can, for instance, be partly left in the articles of clothing, and partly be evacuated to the ambient air.

The action of the washing machine shown in FIG. 1 will now be described. Upon introduction of articles of clothing in the washing drum 14 in the treatment chamber 10 of the machine, the door 12 will be closed and locked in a non specified manner. After this moment, the treatment chamber will be evacuated of air, which takes place through the opening of the valve 69 and a pump 67 is actuated and works until the pressure is about 5.5 bar. When a pressure sensor 70 has detected this pressure in the treatment chamber 10, the valve 69 is closed and the pump 67 stopped. The next step is represented by a pre-pressurization of the treatment chamber 10, i.e. a connecting path is established from the supply tank 18 to the treatment chamber 10 in such a way that the pressure in the treatment chamber 10 attains a level of approximately 10 bar. The connection path is formed by the tube 26, the valves 29 and 33, the tube 30, the valve 34 and a tube 32. When the new pressure level has been attained in the treatment chamber 10, the valve 34 is closed and a valve 68 is opened for feeding new carbon dioxide to the treatment chamber 10 from an external supply, i.e. gas tube furnished by a gas deliverer. The duty of this additional carbon dioxide is to compensate for carbon dioxide, which was lost during the previous treatment phase of the washing machine. For this purpose, the valve 68 is held open during a suitable time, and will be closed thereupon.

After refilling of new carbon dioxide to the system, liquid carbon dioxide should be fed to the treatment chamber 10 from the supply tank 18. This phase starts with pressure balancing between the gas-side of the supply tank 18, i.e. the uppermost part of the supply tank, and the treatment chamber 10, and for this purpose, the valve 34 will be opened. The valves 29 and 33 are already open. When the pressures in the treatment chamber 10 and in the supply tank 18 are equalized, the valve 24 will open and liquid carbon dioxide will flow through the tube 20, the valve 24 and the tube 22 into the treatment chamber 10 up to a predetermined level. The amount of transferred carbon dioxide can easily be determined through measuring the lowering in level in the supply tank 18. By placing the supply tank 18 on a higher level than the treatment chamber 10, the transfer of liquid carbon dioxide from the supply tank to the treatment chamber can take place due to influence of gravitation thereby dispensing of the need for a pump.

When the filling of the treatment chamber has been completed, all valves are closed and the cleaning process in the treatment chamber can commence. This process proceeds for roughly 10 minutes. Shortly afterwards, the drum 14, with its load of garments, rotates in the liquid carbon dioxide, and during the rotation, treats and performs a stirring of the articles of clothing, so as to give the washing liquid, the liquid carbon dioxide, good exposure to all parts of the garments.

When the cleaning process has been finished, the washing liquid in the treatment chamber 10 shall be removed and the pressure therein lowered to atmospheric pressure, so that the door 12 can be opened and the clean garments can be removed from the treatment chamber. The liquid carbon dioxide in the treatment chamber 10 will be taken care of in such a way that it is conveyed to the evaporator chamber 36 to be vaporized and from there, be brought back to the supply tank 18 via a condenser or heat exchanger 44. As in this stage the pressure differs very much between the evaporator chamber 36, the supply tank 18 and the treatment chamber 10, one should increase the pressure in the evaporator chamber 36 step by step through pressure balancing, first with the supply tank 18, and thereupon with the treatment chamber 10, which in this stage has the highest pressure, and from where the liquid carbon dioxide shall also be conveyed to the evaporator chamber 36. In a first step, a connection is established between the supply tank 18 and the evaporator chamber via the tube 26, the valves 29 and 33, the tube 30, another tube 31, a valve 27 and a tube 35 in order to increase the pressure in the evaporator chamber 36 to about the same level as that existing in the supply tank 18. Subsequently the valves 29 and 33 are closed.

In a second step, pressure balancing shall take place between the treatment chamber 10 and the evaporator chamber 36, and for this purpose, the valve 34 will be opened to establish a connection between the treatment chamber 10 and the evaporator chamber 36 through the tube 32, the valve 34, the tube 31, the valve 27 and the tube 35. When the pressures are equal in the treatment chamber 10 and the evaporator chamber 36, a valve 42 is opened so that a connection is opened between the lower part of the treatment chamber 10 and the evaporator chamber 36 via the tube 38, the valve 42 and the tube 40. The valve 42 is kept open as long as required for all free liquid carbon dioxide in the treatment chamber 10 to leave for the evaporator chamber 36. If the treatment chamber 10 is located above the evaporator chamber 36, the transfer of liquid carbon dioxide from the treatment chamber to the evaporator chamber can take place by means of gravitation. Otherwise, a pump will be necessary to transfer the liquid carbon dioxide.

The evaporator chamber 36 now contains dirt-mingled washing liquid and liquid carbon dioxide from the treatment chamber 10, and in its upper part, gaseous carbon dioxide. To separate the dirt from the liquid carbon dioxide, a process of distillation will follow, where gaseous carbon dioxide, with aid of the compressor 46, will be sucked from the evaporator chamber 36, through the condenser or heat exchanger 44, and conveyed to the supply tank 18, where the carbon dioxide again reaches its liquid state. Now the valve 42 closes and the valves 33 and 54 open while the valve 64 and a valve 65 are activated to regulate the pressure in the tube upstream the valves and compensate for the pressure in the compressor 46 and in the supply tank 18. The compressor 46 is started and is allowed to run until the pressure in the evaporator chamber tends to decrease. The compressor sucks gaseous carbon dioxide from the evaporator chamber 36 through the tube 35, the valve 27, the tube 31, the tube 30, the valve 33 and the tube 66 and gives off gaseous carbon dioxide at enhanced pressure and heat content through the tube 50, the valve 54, the tube 52 to the heat exchanger 44, where heat is emitted to the evaporator chamber 36 under condensation of the gaseous carbon dioxide. In this phase, the gas is essentially condensed and can be conveyed through the tube 56 to a further heat exchanger 62, the task of which is to completely condense the remaining gaseous carbon dioxide in order to convey only liquid carbon dioxide back to the supply tank 18 via the tube 58, the valves 64 and 65 and the tube 60.

When the distillation process has been finished, preparations for opening the door 12 and taking out of the clean articles of clothing follow. For this purpose, first the pressure in the treatment chamber 10 has to be decreased and should assume the value 1.5 bar. Thus the valve 33 will be closed while valve 55 is opened and the compressor 46 is started and can work until the pressure in the treatment chamber 10 has assumed the desired value of 1.5 bar. To make it possible to open the door 12, the pressure in the treatment chamber must be decreased further to the value 0 bar, and for this purpose a so called free-blowing takes place, which is brought about by opening a valve 39, and via a filtering device 41, conveying the remaining gaseous carbon dioxide to the ambient air.

Before the door is opened, the distillate is taken care of, i.e. the dirt segregated in the evaporator chamber 36. This is called dirt-blowing and implies that a valve 43 is rapidly opened and closed to press out the distillate and at the same time minimize the amount of gaseous carbon dioxide accompanying the distillate. After this operation, the cleaning process is completed and the door 12 can be opened for taking out the clean articles of clothing.

Prior to a new washing process, the balance in the supply tank 18 may need adjustments in respect of temperature and pressure. For this purpose, the valves 55, 64 and 65 are opened and the compressor 46 will be started and allowed to run until the pressure in the supply tank 18 assumes a suitable value, for example, 57 bar. If required, the heat exchanger 62 is also activated. Afterwards, all valves are closed and the compressor 46 will be stopped.

For control of the function of the washing machine, preferably, a computerized guide system is provided which receives information on pressure and temperature states in the treatment chamber 10, the supply tank 18 and likewise in the evaporator chamber 36 from suitable temperature and pressure sensors therein. Moreover, it is of value to be able to measure the level of liquid carbon dioxide in the supply tank 18 and in the treatment chamber 10, and to this end, suitable level gauges can be provided. The different sensors for pressure, temperature and level are schematically shown on the drawing, but are not described in detail since they are of conventional designs, and have no specific significance in connection with the invention. The same is valid for the chosen computerized control system, which in the same way can be of any conventional kind.

As evident from the above given description of a preferred embodiment of the invention, the gaseous carbon dioxide in the described washing machine is taken care of practically completely. Due to connections between different parts in the machine, a necessary pressure balancing takes place between containers holding vaporized carbon dioxide, the treatment chamber 10, and the evaporator chamber 36. The pressure balancing takes place before transferring liquid carbon dioxide from the supply tank 18 to the treatment chamber 10 and from the treatment chamber 10 to the evaporator chamber 36, respectively. In relation to the distillation of gaseous carbon dioxide from the evaporator chamber 36, condensing takes place in the condenser or heat exchanger 44 of gaseous carbon dioxide released from the compressor 46 under raised pressure and increased heat content. Heat given off is then utilized to vaporize the liquid carbon dioxide in the evaporator chamber 36. Thus, in this way, one can dispense with specific heating arrangements for the evaporation process.

In the embodiment shown in FIG. 1, a separate vaporizer is arranged. To further simplify the washing machine, in a modified embodiment as shown in FIG. 2, the evaporator chamber 36 is excluded, and the vaporization of liquid carbon dioxide takes place directly from the treatment chamber 10. In the schematically shown example of FIG. 2, the vaporizer has been depicted as a box designated 80, which is located beneath the treatment chamber 10 and contains a heat exchanger 82 of a kind similar to the heat exchanger 44 in FIG. 1.

The function of the device shown in FIG. 2 is essentially the same as the one by the device according to FIG. 1. Owing to that, the vaporization in this embodiment takes place directly from the treatment chamber 10 instead of from a separate evaporator 36. Accordingly, the process steps in the embodiment according to FIG. 1, which relates to the transfer of liquid carbon dioxide from the treatment chamber to the evaporator chamber, as well as some of the necessary pressure balancing moments between the evaporator chamber, the treatment chamber and the supply tank can be dispensed with.

During the condensing progress, the task in both embodiments according to FIG. 1 and FIG. 2 is to empty the treatment chamber of liquid carbon dioxide, and, at the same time, clean the working fluid from impurities having been released from textiles processed in the treatment chamber. In the washing machine according to FIG. 2 the evaporation process, which continues as the treatment phase has been concluded, in brevity takes place in the following manner.

The valves 33, 54 and 64 are opened and the compressor started so that gaseous carbon dioxide is sucked from the treatment chamber 10 through the tubes 32 and 30, the valve 33 and the tube 66. The compressor 46 delivers gaseous carbon dioxide with raised pressure and increased temperature, and gas is conveyed through the tube 50, the valve 54 and the tube 52 to the heat exchanger 82, where it gives off its heat. The carbon dioxide, essentially in liquid state, is conveyed further on via the tube 56 to the heat exchanger 62, where possibly remaining gaseous carbon dioxide is transferred to liquid state. The liquid carbon dioxide is, after that, conveyed through the tube 58, the valve 64 and the tube 60 back to the supply tank 18. Thanks to the evaporator chamber, now constituting a part of the treatment chamber 10, and the heat exchanger 82, to its function as a condenser, the gaseous carbon dioxide is provided in direct connection to the treatment chamber and emits condensing heat to that, at the embodiment according to FIG. 2, an advantageous simplification of the washing machine is obtained. As in the embodiment of FIG. 1, by means of the action of the compressor 46, the working fluid, i.e. carbon dioxide in liquid and gaseous state, as a whole, is completely taken care of by the compressor. Owing to that, the heat released by condensing the carbon dioxide is brought back to the process, the amount of energy needed from outside is restricted, and specific heating devices for evaporation of liquid carbon dioxide can be dispensed with. This also entails that every treatment phase where textiles are cleaned in liquid carbon dioxide can be followed by a distilling phase, so that the liquid state carbon dioxide brought back to the supply tank is always clean. This is not the case in the above mentioned publication WO-99/13148, where during the cleaning process, the liquid carbon dioxide is circulated through filtering means and the supply chamber back to the treatment chamber, and is consequently not completely cleaned like at a distillation process. According to the invention, the problem has found its solution by way of the heat energy available in the evaporator, which has been changed up by a heat pump formed of the compressor means and the condenser means.

The invention is not restricted to the above described embodiment and in the shown drawings, but modifications and additions can be introduced within the concept of invention as defined in the following patent claims.

What is claimed is:

1. An apparatus for cleaning textile articles in a densified liquid state treatment gas comprising:

a treatment chamber having an evaporator therein;

a storage chamber, said treatment chamber and storage chamber being interconnected by conduits; and a compressor to perform an essentially complete discharge of gas state treatment gas from the treatment chamber and to drive a distillation phase, during which densified treatment gas discharged from the treatment chamber is transformed into gas state in the evaporator and returned to the storage chamber via a condenser, wherein the compressor and the condenser form a heat pump which alone provides energy required for evaporation of liquid in the evaporator.

2. The apparatus of claim 1, wherein the condenser is in heat transferring contact with the treatment chamber.

3. The apparatus of claim 2, wherein the condenser includes a vaporizer secured to a bottom portion of the treatment chamber and a heat exchanger extending through the vaporizer, wherein during an evaporator cycle, carbon dioxide gas is conveyed from the treatment chamber via the compressor and through the conduit to be condensed.

* * * * *